United States Patent [19]

Tsuchiya et al.

[11] Patent Number: 5,075,735

[45] Date of Patent: Dec. 24, 1991

[54] ELECTROPHOTOGRAPHIC APPARATUS USING DEVELOPER THAT IS CHANGED FROM A SOLID TO A LIQUID

[75] Inventors: Takao Tsuchiya; Akira Shirakura; Haruo Watanabe; Koichi Kawasumi, all of Kanagawa, Japan

[73] Assignee: Sony Corporation, Tokyo, Japan

[21] Appl. No.: 625,887

[22] Filed: Dec. 11, 1990

[30] Foreign Application Priority Data

Dec. 14, 1989 [JP] Japan ..... 1-324404

[51] Int. Cl.[5] ..... G03G 15/01

[52] U.S. Cl. ..... 355/326; 118/645; 346/157; 354/303; 355/245; 355/256; 355/260; 430/42

[58] Field of Search ..... 430/42, 351, 354, 404; 355/260, 326, 327, 245, 256, 261; 118/645, 653, 661, 647; 346/157; 354/299, 303, 305, 317

[56] References Cited

U.S. PATENT DOCUMENTS 3,079,272 2/1963 Greig ..... 118/653 X
3,345,172 10/1967 Land ..... 354/317
3,431,890 3/1969 Ulary ..... 118/661 X
4,561,745 12/1985 Kinsman et al. ..... 354/299
4,733,256 3/1988 Salmon ..... 346/157
4,919,071 4/1990 Gatti ..... 355/245 X

FOREIGN PATENT DOCUMENTS 0006967 1/1990 Japan .

*Primary Examiner*—A. T. Grimley
*Assistant Examiner*—William J. Royer
*Attorney, Agent, or Firm*—Lewis H. Eslinger; Jay H. Maioli

[57] ABSTRACT

An electrophotographic apparatus utilizes solid developers of a plurality of colors for developing an electrostatic latent image. The solid developers are solid at normal temperature and are changed into liquid by heating. The liquid developers are supplied to the static latent image and develop it. The solid developers of a plurality of colors are accommodated within a single container in a predetermined order so that the electrophotographic apparatus can be simplified and made inexpensive.

9 Claims, 2 Drawing Sheets

ELECTROPHOTOGRAPHIC APPARATUS USING DEVELOPER THAT IS CHANGED FROM A SOLID TO A LIQUID

BACKGROUND OF THE INVENTION

1. Field of the Invention

The present invention relates generally to electrophotographic apparatus and, more particularly, to an electrophotographic apparatus in which solid developers of a plurality of colors which are solid at room temperature and changed into liquid when heated are heated by a predetermined heater and changed into liquid and supplied to an electrostatic latent image so that the electrostatic latent image is developed as a multi-colored printed image.

2. Description of the Prior Art

In an electrostatic process such as an electronic photograph developing process or the like, a photosensitive material such as a photoconductor or the like is uniformly electrified and selectively illuminated by a laser beam. Then, charges on the portion illuminated by the laser beam are extinguished to form an electrostatic latent image. Alternatively, a dielectric material such as a paper, a plastic film or the like is electrified by an electrostatic electrode called a multi-stylus head in response to an electrical signal, thereby forming an electrostatic latent image. In order to develop this electrostatic latent image, a toner or developer charged to the polarity opposite to that of an electrostatic latent image carrier (photoconductor drum, dielectric film and so on) having the electrostatic latent image is electrostatically deposited on the electrified portion of the photoconductor drum and then developed.

As a developing method, a dry type developing system using a dry developer and a wet type developing system using liquid developer are known. The dry developers are generally formed of very small particle powders. For this reason, if the dry developers are scattered, a problem of environmetal disruption occurs. To solve this problem, a developer cartridge in which dry developers are accommodated should be constructed as a sealed type. Today, most of the developing apparatus are of such a type that an electrostatic latent image carrier and a developing portion are wholly exchanged. Therefore, this type of developing apparatus is expensive but the dry developer is excellent in preservation and if the developers are accommodated within the developer cartridge, they are easy to handle.

On the other hand, the liquid developer is formed by dispersing into insulating liquid particle powders of colorant such as dye stuff and the like. By a centrifugal pump or the like, the liquid developer is injected from the developer container through a slit of a developing electrode used to charge the electrostatic latent image to the polarity opposite to that of the electrostatic latent image carrier, whereby colorant particle powders are electrostatically deposited on the electrostatic latent image. In the conventional developing apparatus, extra liquid developers, which are not deposited on the electrostatic latent image, are returned to and accommodated again within the developer container, rendering the concentration of colorant particle powders in the liquid developers low. This makes control of the concentration of the developing liquid (liquid developer) difficult. Further, various problems arise such as that pollution occurs because of the leakage of liquid developer in the developing process or when the developing apparatus is held or when the liquid developer is exchanged and that the preservation of liquid developer is difficult because the colorant particle powders in the liquid developer tend to coagulate and precipitate. The electrostatic process utilizing the liquid developer offers the possibility that the resolution and gradation of the picture will be increased to levels equal to those of a silver halide photograph. Therefore, this electrostatic process is expected as an electrostatic latent image developing system which is suitably applied to a printing apparatus of high image quality such as a video printer used in an electronic still camera or the like.

In the background set forth so far, the assignee of the present application has previously proposed a method of developing an electrostatic latent image (see Japanese Patent Application No. 63-156847) and corresponding U.S. Application Ser. No. 07/609,027 filed Oct. 30, 1990, which is a continuation of application Ser. No. 07/366,863 filed Jun. 15, 1989. This previously-proposed method can solve various problems that the liquid developer is difficult to handle, the liquid developer tends to be smudged, the maintenace of liquid developer is difficult and the preservation of liquid developer is poor while making effective use of advantages of the electrostatic process using the liquid developer. In other words, this electrostatic latent image developing method is characterized in that a developer (i.e. toner) in which a colorant is dispersed into an electrostatic insulating organic material solid at normal temperature is heated and changed into liquid and an electrostatic latent image is developed by the thus liquefied developer in a dry developing fashion.

In the conventional method as described above, however, considering an electrophotographic apparatus capable of printing a video image in a plurality of colors, for example, three colors such as yellow (Y), magenta (M) and cyan (C), three containers for solid developers of three colors are required, which makes the electrophotographic apparatus complicated and expensive.

OBJECTS AND SUMMARY OF THE INVENTION

Accordingly, it is an object of the present invention to provide an improved electrophotographic apparatus which can substantially eliminate the aforenoted shortcomings and disadvantages encountered with the prior art.

More specifically, it is an object of the present invention to provide an electrophotographic apparatus in which solid developers of a plurality of colors are accommodated within a single container so that the apparatus can be simplified in construction and operation.

It is another object of the present invention to provide an electrophotographic apparatus which can be made inexpensive.

In accordance with a first aspect of the present invention, a developer cartridge comprises of solid developers of a plurality of colors for developing an electrostatic latent image arranged in a predetermined order, in which the solid developers are solid at normal temperature and are changed into liquid by heating, and a single container for supporting the solid developers.

As a second aspect of the present invention, an electrophotographic apparatus utilizes solid developers of a plurality of colors being arranged in a predetermined order, in which the solid developers are solid at normal temperature and are changed into liquid by heating. This electrophotographic apparatus is comprises a cartridge made of a single container for supporting the solid developers, a photoconductor drum for forming an electrostatic latent image on its surface, a first charger for charging the photoconductor drum to a first polarity, exposure means for extinguishing the charges on the photoconductor drum corresponding to image information and forming an electrostatic latent image on the photoconductor drum, a heater for heating and melting the solid developers into liquid, a second charger for charging melted developers to a polarity opposite to that of the charges on the photoconductor drum, and a waste developer tank for receiving excessive developer.

The above, and other objects, features and advantages of the present invention will be apparent in the following detailed description of the preferred embodiments when read in conjunction with the accompanying drawings, in which like reference numerals are used to identify the same or similar parts in the several views.

DETAILED DESCRIPTION OF THE PREFERRED EMBODIMENTS

The present invention will hereinafter be described in detail with reference to FIGS. 1 and 2.

Figure 1:
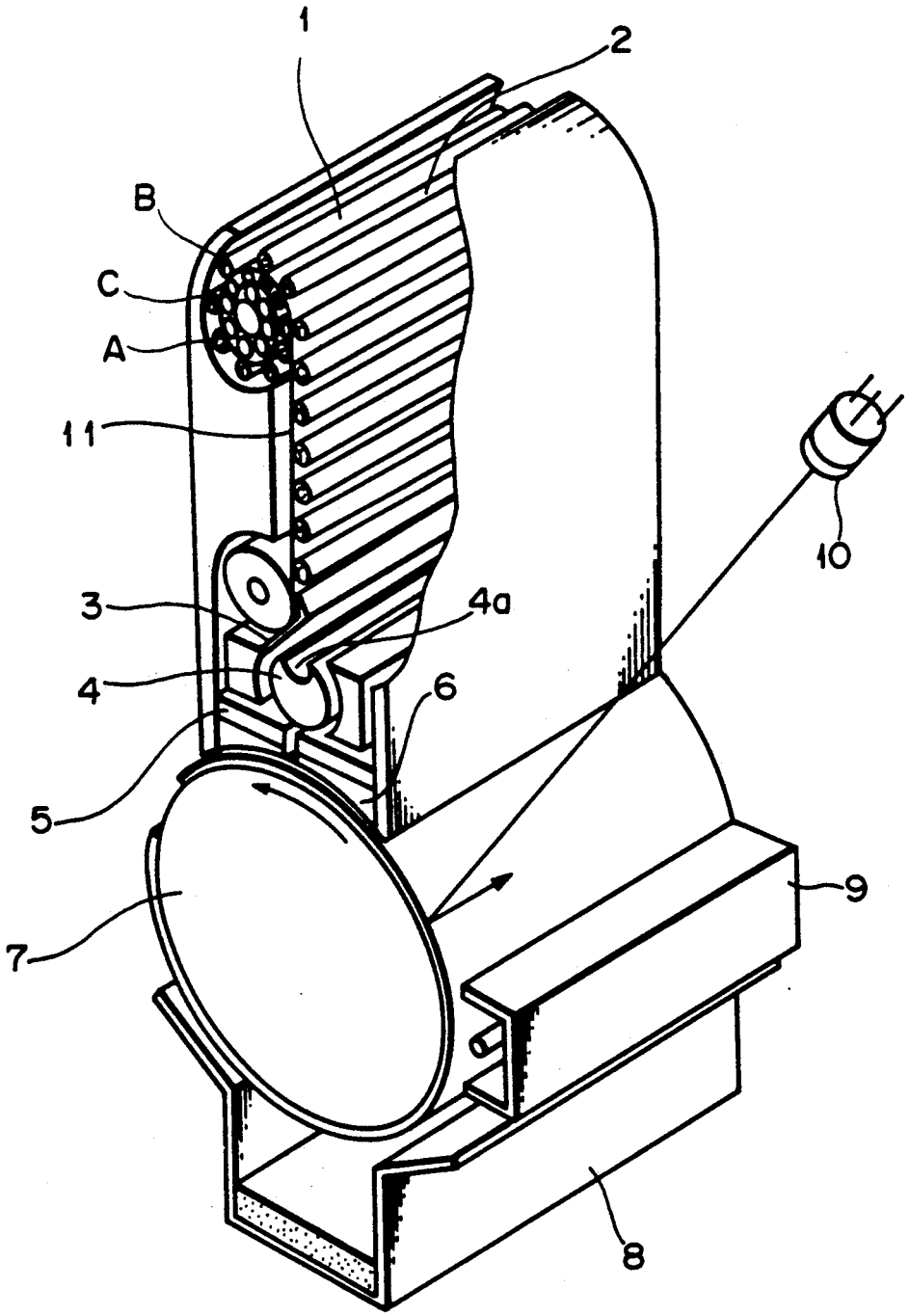
FIG. 1 is a partly cutaway perspective view of a first embodiment of an electrophotographic apparatus according to the present invention.

FIG. 1 shows a partially cutaway perspective view of the arrangement of the first embodiment of the electrophotographic apparatus according to the present invention.

Referring to FIG. 1, solid developers 1 are accommodated within a developer accommodating portion 2. Each of the solid developers (developers A, B, and C) 1 is cut by a cutter 3 and the solid developers 1 thus cut are received by a rotary shutter 4. The solid developers 1 are heated and liquefied (i.e. melted) by a heater 5, and a developing electrode 6 charges the solid developer 1 so as to have a polarity opposite to that of photoconductive material (one example of electrostatic latent image carrier). A photoconductor drum 7 is provided, on a circumference of a cylindrical-shaped body of which a photoconductive material is wrapped. A waste developer accommodating portion (waste developer tank) 8 is adapted to accommodate extra liquid developers which are not deposited on the photoconductive material. A corona discharge member 9 is provided to charge the entire surface of the photoconductive material by, for example, negative charges uniformly. A semiconductor infrared laser light source (exposure system) 10 is adapted to form an electrostatic latent image by selectively illuminating the surface of the photoconductive material in response to a video image signal so that charges on the portion illuminated with the laser beam are extinguished to form an electrostatic latent image.

In an electrical charging step, the photoconductor drum 7 is electrically charged to a minus polarity by suitable charging means, such as the corona discharge member 9. At an ensuing exposure step, selective light exposure is performed in association with the image information, using suitable exposure means, such as the semiconductor infrared laser light source 10, for eliminating negative charges of the area exposed to light.

Irrespective of the method for forming an electrostatic latent image or the kind of the photoconductor drum 7, any well-known organic or inorganic photoconductive materials may be used for forming the photoconductor drum 7. Examples of the well-known organic photoconductive materials now in use include electrophotographic sensitized base materials consisting of poly-N-vinyl-carazole and 2, 4, 7-trinitrofluorene-9-on, poly-N-vinylcarbazole sensitized with pyrylium type colorant, poly-N-vinylcarbazole sensitized with cyanine type colorant, and an electrophotographic sensitized base material consisting mainly of organic pigments of eutectic complexes consisting of colorants and resins. Examples of inorganic photoconductive materials include zinc oxide, zinc sulfide, cadmium sulfide, selenium, selenium-tellurium alloy, selenium-arsenic alloy, selenium-tellurium-arsenic alloy and amorphous silicon type materials.

At a subsequent developing step, the photoconductor drum 7, on which the electrostatic latent image has been formed as described hereinabove, is passed under the developing electrode 6.

The solid developers 1 accommodated within the developer accommodating portion 2 are arranged on a belt 11 at every picture in the order of a plurality of colors, for examples, yellow (Y), magenta (M) and cyan (C). When the belt 11 is moved downwardly from the above and the solid developers 1 reach the cutter 3, the solid developers 1 are cut one by one and dropped into a slot (i.e. groove) 4*a* of the rotary shutter 4 immediately before each color is developed. The solid developers 1 in the slot 4*a* of the rotary shutter 4 are brought in the place of the heater 5 by the rotation of the rotary shutter 4, heated, liquefied and fed to a spacing between the photoconductor drum 7 and the developing electrode 6, thereby being used to develop the latent image.

The developer 1 supplied to the developing electrode 6 consists of colorant particles dispersed in an electrically insulating organic material which is solid at least at room temperature and which is changed between the solid and liquid states upon heating and cooling.

The electrically insulating organic material has a melting point of not lower than 30° C. and preferably not lower than 40° C. in view of the ordinary operating environment and for ease of handling. Although there is no specific upper limit to the melting point, practically it is about 100° C. and preferably not higher than 80° C. when considering that additional energy is consumed for heating an insulating material with too high a melting point. Also, the upper limit of the melting point should not exceed the heat resisting temperature of the material customarily employed as the base material when the organic material is held on a base material for use.

Among the materials meeting these requirements are paraffins, waxes and mixtures thereof. The paraffins include various normal paraffins with 19 to 60 carbon atoms, such as nonadecane to hexacontane. The waxes include plant waxes such as Carnauba wax or cotton wax, animal waxes such as bees wax, ozokerite, and petroleum waxes such as paraffin waxes, crystallite waxes or petrolatum. These materials are dielectrics having dielectric constants e on the order of 1.9 to 2.3.

In addition, crystalline high molecular material having long alkyl groups at the side chains, such as homopolymers or copolymers of polyethylene, polyacrylamide, poly-n-stearyl acrylate or poly-n-stearyl methacrylate, such as copoly-n-stearyl acrylate ethyl methacrylate, may be employed. However, the aforementioned paraffins and waxes are preferred in view of their viscosity at the time of heating.

The colorant particles dispersed into the electrically insulating organic material may be organic or inorganic pigments or dyestuffs that are well-known in the art, or mixtures thereof.

The inorganic pigments include for example chromium type, iron type or cobalt type pigments, ultramarine or Prussian blue. The organic pigments or dyestuffs include Hansa Yellow (C. I. 11680), Benzidine Yellow (C. I. 21090), Benzidine Orange (C. I. 21110), Fast Red (C. I. 37085), Brilliant Carmin 3B (C. I. 16015 - Lake), Phthalocyanin Blue (C. I. 74160), Victoria Blue (C. I. 42595 - Lake), spirit Black (C. I. 50415), Oil Blue (C. I. 74350), Alkali Blue (C. I. 42770A), Fast Scarlet (C. I. 12315), Lodamin 6B (C. I. 45160), Lodamin Lake (C. I. 45160 Lake), Fast Sky Blue (C. I. 74200 - Lake), Nigrocyn (C. I. 50415) or carbon black. These may be used alone or in combination. Those exhibiting desired coloration may be used selectively.

The developer may also contain resins, in addition to the electrically insulating organic materials and colorant particles, for improving dispersibility or fixation of the colorants. These resins may be suitably selected from known materials and may include for example rubbers such as butadiene rubber, styrene-butadiene rubber, cyclized rubber or natural rubber, synthetic resins such as styrene, vinyl toluene, polyester, polycarbonate or polyvinyl acetate, rosin type resin, hydrogenated rosin type resin, alkyd resins containing modified alkyds, such as linseed oil, modified alkyd resins and natural resins such as polyterpenes. In additional phenol resins, modified phenol resins such as phenol formalin resins, phthalic acid pentaerythritol, Kumaronindene resins, ester gum resins or vegetable oil polyamide resins may also be useful. Halogenated hydrocarbon polymers, such as polyvinyl chloride or chlorinated polypropylene, synthetic rubbers such as vinyl toluenebutadiene or butadiene-isoprene, polymers of acrylic monomers having long-chain alkyl groups, such as 2-ethylhexyl methacrylate, lauryl methacrylate, stearyl methacrylate, lauryl acrylate or octyl acrylate or copolymers thereof with other polymerizable monomers, such as styrene-lauryl methacrylate copolymer or acrylic acid-lauryl methacrylate copolymer, polyolefins such as polyethylene or polyterpenes, may also be employed.

The above developer is usually admixed with electrical charge donors. This applies for the developer employed herein. The electrical charge donors employed for this purpose include, for example, metal salts of fatty acids, such as naphthenic acid, octenic acid, oleic acid, stearic acid, isostearic acid or lauric acid, metal salts of sulfosuccinates, oil-soluble metal salts of sulfonic acid, metal salts of phosphates, metal salts of abietic acid, metal salts of aromatic carboxylic acid or metal salts of aromatic sulfonic acid.

For improving the charges of the colorant particles, fine particles of metal oxides, such as $SIO_2$, $AL_2O_3$, $TiO_2$, ZnO, $Ga_2O_3$, $In_2O_3$, $GeO_2$, $SnO_2$, $PbO_2$ or MgO or mixtures thereof, may be employed as charge increasing additives.

Referring to the relative contents of the above ingredients, the colorant particles are employed preferably at a rate of 0.01 to 100 g, and more preferably at a rate of 0.1 to 10 g, to 1 liter of the electrically insulating organic material in the melted state, while the charge donors are employed usually at a rate of 0.001 to 10 g, and preferably at a rate of 0.01 to 1 g, to 1 liter of the organic material. The charge increasing additive is added in an amount of not more than the same amount, as that of the colorant particles.

The above developer may be heated by the heating means 5 into the melted state. The heating temperature may be suitably set in dependence upon, for example, the melting point, and may usually be 30° to 130° C. and preferably to be 40° to 110° C.

When the liquefied developer 1 is contacted with the photoconductor drum 7, the colorant particles migrate towards and are deposited at the negative electrical charges.

Meanwhile, when the photoconductor drum 7 and the developer 1 are solidified immediately after contact, the image tends to be degraded in quality. It is therefore preferred to provide heating means for heating the photoconductor drum 7.

The heating temperature for the photoconductor drum 7 may be suitably set in dependence upon the kinds and characteristics of the sensitized material used. It is preferably not lower than the liquidus temperature of the developer 1 and is usually set in the range from room temperature to 130° C., and preferably in the range of 30° to 110° C.

The developing method of the present invention may be applied for developing an electrostatic latent image formed by means other than sensitization, such as by electrification of a dielectric material by an electrifying needle.

As described above, in this embodiment, the solid developers of three colors are accommodated within the developer accommodating portion 2 which is the single container in the predetermined order so that, unlike the prior art, containers exclusive for solid developers of three colors need not be provided, thus making the apparatus simple and inexpensive.

Figure 2:
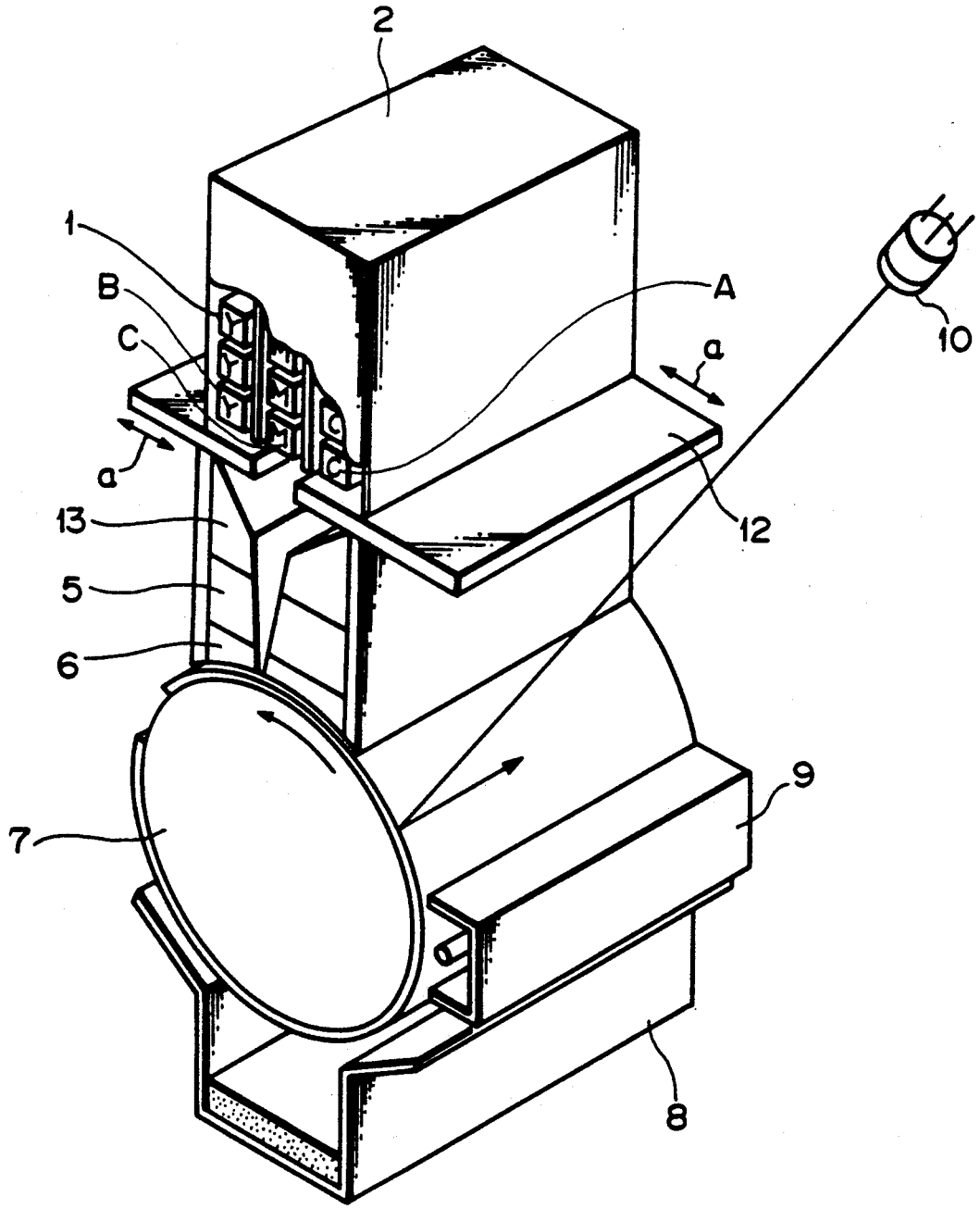
FIG. 2 is a partly cutaway perspective view of a second embodiment of the present invention.

FIG. 2 shows a second embodiment of the electrophotographic apparatus according to the present invention. In FIG. 2, like parts corresponding to those of FIG. 1 are marked with the same references and therefore need not be described in detail.

In this embodiment, solid developers (B, C and A) 1 of three colors, i.e. yellow, magenta and cyan are laminated within the developer accommodating portion 2 at every color and taken out one by one therefrom by a shutter 12 which is opened left to right as shown by an arrow a just before being developed. These solid developers A, B and C are brought to the heater 5 via an introducing member 13, heated and liquefied and supplied to the spacing between the photoconductor drum 7 and the developing electrode 6, thereby being developed.

As mentioned above, according to the second embodiment, since the solid developers A, B and C of three colors are accommodated within the single container, the apparatus can be simplified and made inexpensive similarly to the first embodiment.

In the aforementioned embodiments, the portions such as the heater 5, the developing electrode 6 or the like forming the so-called developing device may be independently provided for each of the colors. While the solid developers of three colors, i.e., yellow, magenta and cyan are employed in the aforementioned embodiments, the present invention can be similarly applied to solid developers of a plurality of colors other than yellow, magenta and cyan.

The compositions of the solid developers made of yellow, magenta and cyan will be described below.

Developer A

The developer A is the cyan-color electrostatic latent image developer.

0.625 g of Lionol Blue KX-F1 produced by Toyo Ink Co. Ltd., as colorant, and 0.5 g of IP 2825, isoparaffin solvent produced by Idemitsu Sekiyu Co. Ltd., were comminuted by the Fouver-Maler method to produce a paste. This paste was dispersed in 50 ml of a separate isoparaffin solvent "Isoper H" produced by Esso Inc. and admixed with 0.05 g of "Aluminum Oxide C" produced by Nippon Aerosil Co. Ltd., as the charge reinforcing agent, and the resulting mixture was dispersed for 12 hours in a paint shaker together with alumina beads. The resulting dispersion was admixed with 9.5 g of a 50%-solution of "FR101", acrylic resin produced by the Mitsubishi Rayon Co. Ltd. in toluene, 0.025 g of zirconium naphthenate as the charge donor and 0.025 g of calcium naphthenate to produce a concentrated developing liquid.

Then, 120 ml of paraffin melting at 42° to 44° C. was previously melted at 70° C. and 5 ml of the concentrated developing liquid was dispersed in the solution to produce a blue color latent image developer.

Developer B

The developer B is a yellow-colored electrostatic latent image developer.

0.5 g of Similar Fast Yellow 8GF produced by Dai Nippon Ink Co. Ltd., as colorant, and 0.5 g IP2825, isoparaffin solvent produced by Idemitsu Sekiyu Co. Ltd., were comminuted by the Fouver-Maler method to produce a paste. This paste was dispersed in 50 ml of a separate isoparaffin solvent "Isoper H" produced by Esso Inc. and admixed with 0.01 g of "Aerosil 200" Ultra fine particles of dry silica produced by Nippon Aerosil Co. Ltd., as the charge reinforcing agent, and the resulting mixture was dispersed for 18 hours in a paint shaker together with glass beads. The method for preparing the concentrated developing liquid and the electrostatic latent image developer is similar to the method described in connection with the developer A.

Developer C

The developer C is the magenta-color electrostatic latent image developer.

0.8 g of Simular Rodamin Y toner F, produced by the Dai Nippon Ink Co. Ltd. as the colorant and 0.5 g of linseed oil were comminuted by the Fouver-Maler method to produce a paste. This paste was dispersed in 50 ml of "Isoper H", an isoparaffin solvent produced by Esso Inc. and the dispersing operation was performed for 18 hours in a paint shaker together with glass beads. The method for preparing the concentrated developing liquid and the latent image developer is the same as that described in connection with the developer A.

On the other hand, a sheet of transparent electrically conductive film (of 0.2 μm thickness) and a modified vinyl acetate resin (film thickness, 2 μm) were laminated on a polyethylene terephthalate film (125 μm thick) and a photosensitive layer (film thickness, 8 μm) containing 2 mg of cyanine dye ("NK 2892" produced by Nippon Kanko Shikiso Co. Ltd.) as sensitizer was formed on the laminate to produce the sensitized base material. Since the image quality may be degraded when the developers solidify immediately after contact with the sensitized base material, the stage 10 for securing the base material was heated to 55° C. by the heating means.

As a result, a satisfactory full-color image comparable in resolution and definition with a silver halide photograph is consistently obtained.

As set forth above, according to the present invention, in contrast to the prior art, since the solid developers of a plurality of different colors are accommodated within the single container in the predetermined order, developer containers for a plurality of colors need not be provided. Therefore, the electrophotographic apparatus of the present invention can be simplified and made inexpensive.

Having described preferred embodiments of the invention with reference to the accompanying drawings, it is to be understood that the invention is not limited to those precise embodiments and that various changes and modifications thereof could be effected by one skilled in the art without departing from the spirit or scope of the novel concepts of the invention as defined in the appended claims.

We claim as our invention:

1. A developer cartridge comprising:
   a plurality of developers of a corresponding plurality of colors for developing an electrostatic latent image being arranged in a predetermined order, in which said developers are solid at room temperature and are changed into liquid by heating; and
   a single container for supporting said solid developers.

2. A developer cartridge according to claim 1 wherein said solid developers of each color are divided into a plurality of pieces each having a quantity for making one picture.

3. A developer cartridge according to claim 1 wherein said plurality of colors include yellow, magenta and cyan.

4. A developer cartridge according to claim 1 wherein said container comprises a belt carrying said solid developers in a predetermined order.

5. A developer cartridge according to claim 1 wherein said container comprises separate compartments for each color of said solid developers.

6. An electrophotographic apparatus comprising:
   a cartridge comprising a single container for supporting solid developers of a plurality of colors in a predetermined order for developing an electrostatic latent image, with said solid developers being solid at room temperature and changed to a liquid by heating;
   a photoconductor drum for forming an electrostatic latent image on its surface;
   a first charger for charging said photoconductor drum to a first polarity;
   exposure means for extinguishing the charges on said photoconductor drum corresponding to image information and forming an electrostatic latent image on said photoconductor drum;
   a heater for heating and melting said solid developers into liquid;
   a second charger for charging melted developers to a polarity opposite to that of the charges on said photoconductor drum; and
   a waste developer tank for receiving excess developer.

7. An electrophotographic apparatus according to claim 6 wherein said heater is common to said solid developers of a plurality of colors.

8. An electrophotographic apparatus according to claim 6 wherein said second charger is common to said solid developers of a plurality of colors.

9. An electrophotographic apparatus according to claim 6 wherein said exposure means includes a semiconductor laser.

* * * * *